United States Patent [19]

Schwartz

[11] 4,358,131

[45] Nov. 9, 1982

[54] HEEL BINDING FOR CROSS-COUNTRY SKIS

[76] Inventor: Thomas A. Schwartz, 23 Greenwood St., Wakefield, Mass. 01880

[21] Appl. No.: 222,370

[22] Filed: Jan. 5, 1981

[51] Int. Cl.[3] ..... A63C 9/18

[52] U.S. Cl. ..... 280/614; 280/615; 280/623; 280/624; 280/625; 280/632

[58] Field of Search ..... 280/614, 615, 618, 623, 280/624, 625, 630, 631, 632

[56] References Cited

U.S. PATENT DOCUMENTS

| | | | |
|---|---|---|---|
| 2,116,969 | 5/1938 | Cyr | 36/2.5 |
| 3,398,969 | 8/1968 | Perry | 280/11.35 |
| 3,560,011 | 2/1971 | Spademan | 280/11.35 |
| 3,618,233 | 11/1971 | Eie | 36/2.5 |
| 3,775,866 | 12/1973 | Marker | 36/2.5 |
| 3,934,893 | 1/1976 | Greenleaf | 280/615 |
| 3,979,131 | 9/1976 | Ginther | 280/615 |
| 3,979,132 | 9/1976 | Iser-Iser | 280/614 |
| 4,113,275 | 9/1978 | Sherwin | 280/615 |
| 4,154,008 | 5/1979 | Jacobs | 36/117 |
| 4,176,856 | 12/1979 | Glaser | 280/615 |

FOREIGN PATENT DOCUMENTS

| | | | |
|---|---|---|---|
| 61783 | 10/1913 | Austria . | |
| 173649 | 1/1953 | Austria . | |
| 236147 | 12/1910 | Fed. Rep. of Germany | 280/624 |
| 807789 | 7/1951 | Fed. Rep. of Germany | 280/632 |
| 303307 | 4/1953 | Switzerland . | |
| 552399 | 6/1974 | Switzerland . | |

*Primary Examiner*—David M. Mitchell
*Assistant Examiner*—Kenneth R. Rice
*Attorney, Agent, or Firm*—Lahive & Cockfield

[57] ABSTRACT

A heel binding for a cross-country ski has opposing latches movable toward each other under engagement by spaced apart flexible beams that force the latches together to capture a projection from the heel of a skier's shoe to hold the heel to the ski. The inside surfaces of the latches are cam-shaped to allow releasing force on the pin to urge the latches outward against the flexible beams, and to release the pin when the force is substantial enough, as in a fall. A collar slidable on the flexible beams adjusts the effective stiffness of the flexible beams to adjust the releasing force.

7 Claims, 5 Drawing Figures

HEEL BINDING FOR CROSS-COUNTRY SKIS

This invention relates to ski binding, and particularly to heel bindings for cross-country skis to allow their use in a downhill mode.

BACKGROUND OF THE INVENTION

In the cross-country (also called Nordic) style of skiing, the ski shoe is secured to the ski only at the toe. This allows the so-called "kick and glide" motion for travelling over flat terrain when using the skis. In the downhill (or Alpine) style of skiing, on the other hand, the ski shoe or boot is fixed firmly to the ski both at heel and toe. This allows the skier to transfer weight selectively and precisely to the skis and particularly the ski edges, thereby permitting greater control of the skis for turning and maneuvering. There are other differences between the two styles of skiing, such as the cross-country ski generally being narrower, lighter and more flexible than the downhill ski, but the principal difference is in the binding of the skier's foot to the ski.

Under some circumstances, the cross country skier may desire the control of his or her skis that a downhill-type binding would give. One way to accomplish this is to provide a means for fixing the heel of a cross-country ski shoe to the ski. The invention provides such a means.

There have been bindings developed over the years to provide the option of securing the heel of a ski shoe or boot to the ski. Most of these are complex, or heavy, or hard to use, or require extensive modification of existing equipment. It is an object of this invention to provide a heel binding for a cross-country ski that is light, convenient to use with conventional equipment, and that is simple and inexpensive to manufacture. It is another object to provide such a heel binding with an adjustable heel release pressure when it is in the downhill mode to allow for release of the heel in the event of a serious fall.

SUMMARY OF THE INVENTION

A heel binding for a cross-country ski comprises a base fixed to the ski, oppositely facing first and second latch members rotatably mounted on the base for movement from a first spaced apart position to a second position in which oppositely facing first and second latch surfaces close to releasably secure a heel portion, the latch members being biased in the open, first position, and spaced apart first and second flexible beams mounted on the base for movement between a first position in which the beams are out of operative contact with the latch members and a second position in which the beams flexibly hold the latch members in the second position. The latch surfaces include cam surface portions that are shaped to move the latch members outward against the resistance of the flexible means and release the heel portion when substantial force is applied from the heel portion.

Other features of the invention include a collar slidably mounted on the beams, so that the effective stiffness of the beams may be adjusted, a guide with a V-shaped groove aligned with the latch members, and having the latch members mounted for rotatable movement on axes parallel to the ski axis and the beams mounted on axes transverse to the ski axis, so that the beams engage outside surfaces of the latch members to operatively, slidingly engage the latch members to move them to their closed, second, position when the beams are moved to their second position.

BRIEF DESCRIPTION OF THE DRAWING

Other objects, features and advantages of the invention will be described or will be apparent in the following description of a preferred embodiment of the invention, including the drawings thereof, in which.

DESCRIPTION OF A PREFERRED EMBODIMENT

Figure 1:
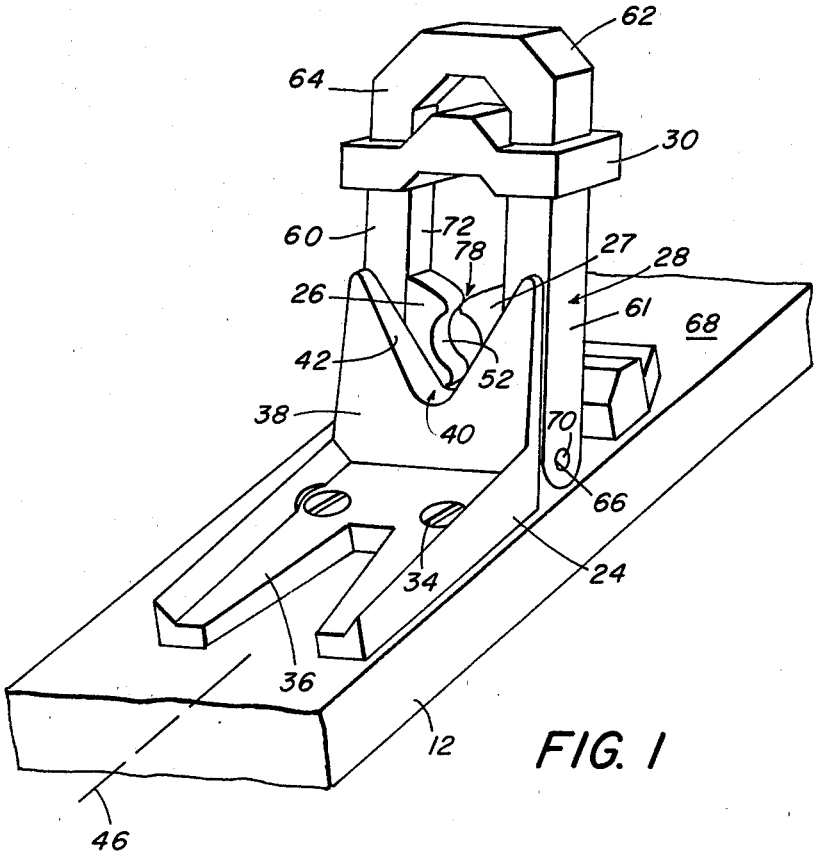
FIG. 1 is a perspective view of the heel binding of the invention secured to a cross-country ski.
Figure 2:
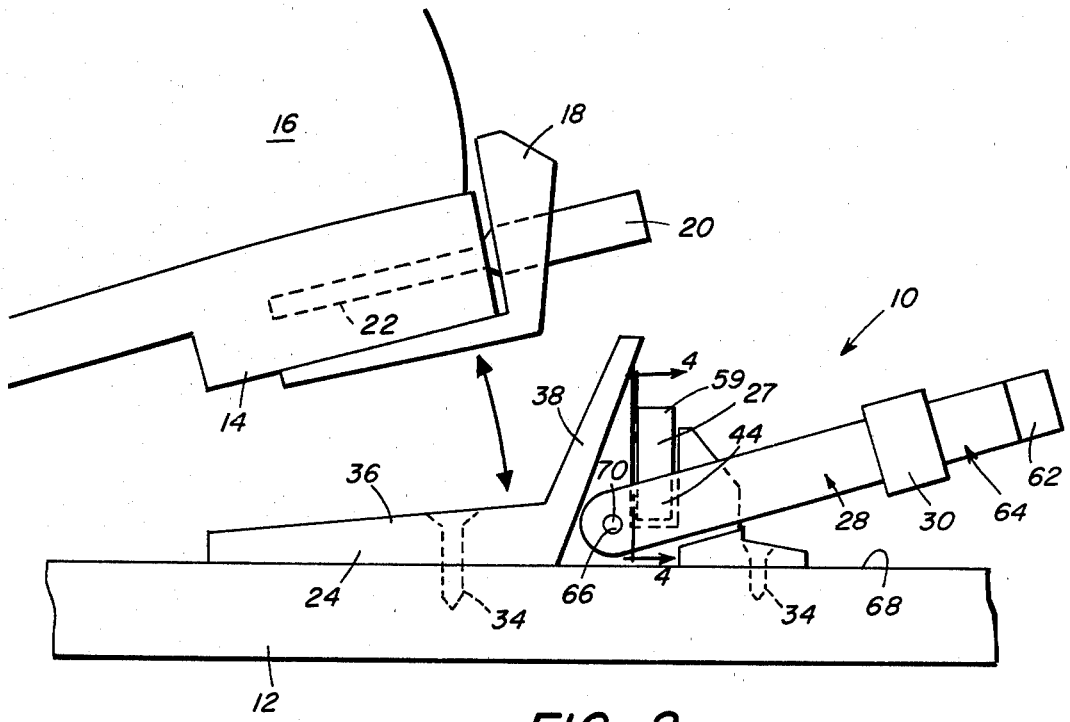
FIG. 2 is a side elevation view of the heel binding of FIG. 1 in a cross-country mode.

As shown in FIGS. 1 and 2, the heel binding 10 is secured to the cross-country ski 12 of the skier, adjacent the heel 14 of the skier's shoe 16. The skier's shoe 16 is modified by the application of a cup adapter 18 to the rear of the shoe to provide a rearwardly projecting pin 20 and to aid in transfer of force from the skier to the projecting pin, and ultimately the binding and ski. In the illustrated embodiment, the pin 20 has a portion 22 embedded in the heel 14. Other, suitable, adapters may be applied to the shoe 16, or the shoe 16 may be manufactured and sold with a rearward projection, as part of the heel 14.

The heel binding 10, which will cooperate with the pin 20, includes a base 24, cam latches 26 and 27, a yoke 28, and a collar 30 for the yoke. The base 24 of the heel binding 10 is fastened to the ski 12 with conventional flat head screws 34. The forward portion of the base 24 includes a forward, horizontal striker plate 36 for positioning under the ski shoe heel 14, and a substantially vertical guide plate 38 with an upturned V-shaped groove 40 having groove sides 42 for centering a downwardly thrust heel pin 20. The rear portion of the base 24 has a slot 44 transverse to the ski axis 46 for receiving the cam latches 26, 27. The preferred material for the base 24 is 30% glass-filled nylon, although other polymers and fillers may be used.

Figure 4:
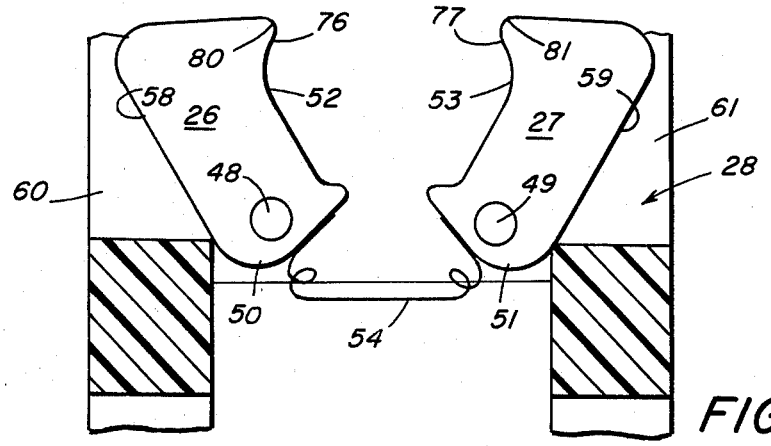
FIG. 4 is a front elevation view (partially in section), along the lines 4—4 of FIG. 2, of the heel binding portion containing the cam latches in the cross-country mode.
Figure 5:
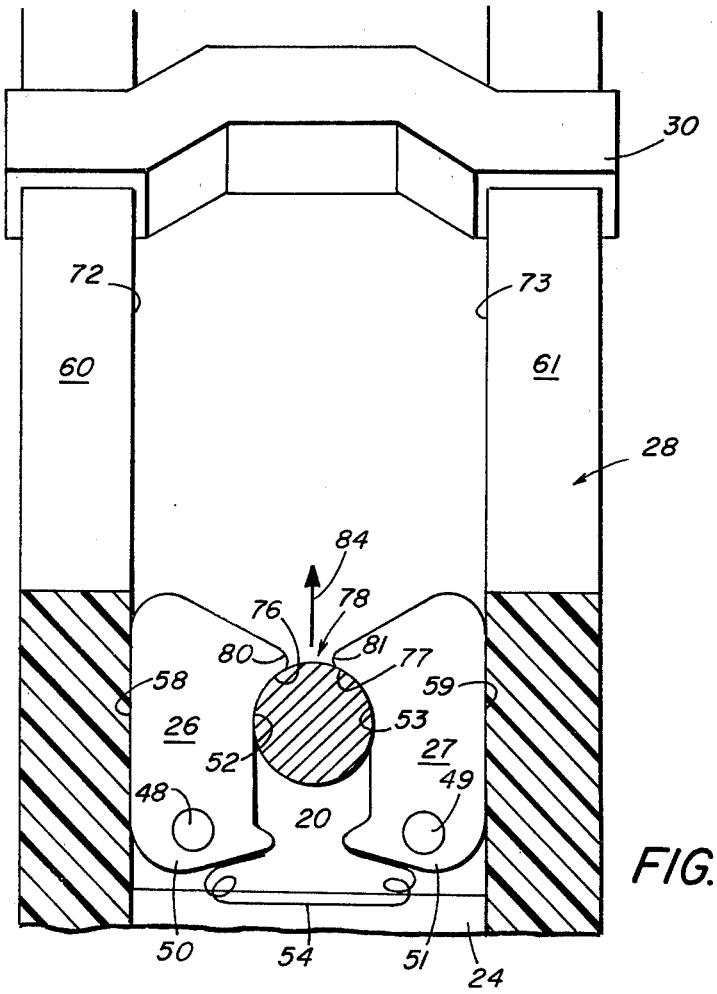
FIG. 5 is a view like that of FIG. 4, along the lines 5—5 of FIG. 3, of the cam latches and the yoke collar of the binding in the downhill mode.

The cam latches 26, 27 are two opposing latches mounted in the base slot 44 for rotation about respective axes 48, 49 through their respective lower portions 50, 51. The cam latch axes 48, 49 are parallel to the ski axis 46. The cam latches 26, 27 are mounted for movement toward each other to achieve a closed position (see FIG. 5), and away from each other to achieve an open position (see FIG. 4). The inner latch surface 52, 53 of each cam latch 26, 27 respectively is shaped to secure the heel pin 20 when the latches are together in the closed position. A spring 54 is located between the lower portions 50, 51 of the cam latches 26, 27 to bias them in the open position (FIGS. 2 and 4) so that the heel pin 20 is free to move up or down. The outer surfaces 58, 59 of the cam latches 26, 27, respectively, extend outwardly when the cam latches are in the open position (FIG. 4), and are generally parallel when the cam latches are in the closed position (FIG. 5). The preferred material for the cam latches 26, 27 is also 30% glass-filled nylon, although other polymers and fillers may be used.

Figure 3:
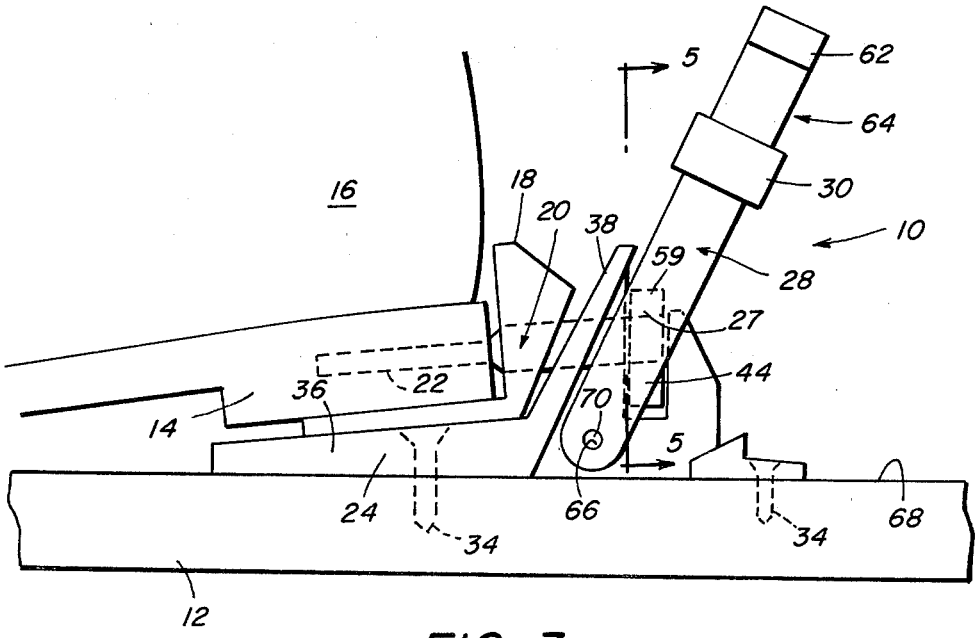
FIG. 3 is a view like that of FIG. 2 of the heel binding, in a downhill mode.

The yoke 28 is a U-shaped piece with two parallel flexible beams 60, 61 joined by an end piece 62 at one end 64 and rotatably mounted on the base 24 by way of pins 66 extending outwardly from the base 24 just above the top surface 68 of the ski 12 and forward of the cam latches 26, 27. The yoke 28 is rotatable, therefore, about an axis 70 transverse to the ski axis 46. The yoke 28 is movable between two positions, a first position in which the yoke 28 is down (see FIG. 2) and out of the way of the outside surfaces 58, 59 of the cam latches 26, 27 so that the cam latches can respond to the bias of the spring 54 and take an open position (see FIG. 4), and a second position in which the yoke 28 is up (see FIG. 3), the inside surfaces 72, 73 of the arms 60, 61 having slidingly, cammingly engaged the outer surfaces 58, 59 of the cam latches 26, 27 to bring the latches together into their closed position (see FIG. 5).

The yoke 28 is formed of material such as a copolyester elastomer or urethane, though other polymers will do, so that the arms 60, 61 of the yoke 28 are flexible and will flex outwardly, should a substantial force be exerted by the heel pin 20 captured between the cam latches 26, 27. By way of example, the material used in the illustrated embodiment is that sold under the designation "Hytrel 55" by E. I. duPont de Nemours & Co., Inc. of Wilmington, Delaware. The upper portions of the inner surfaces 52, 53 of the cam latches 26, 27 form cam surfaces 76, 77, respectively, that are rounded to generally conform to the curvature of the pin 20. A gap 78 exists between the innermost parts 80, 81 of the cam surfaces 76, 77, that can widen enough as upward force by the pin 20 (indicated by the arrow 84) forces apart the cam latches 26, 27 against the yoke beams 60, 61, for the pin 20 to escape the cam latches 26, 27 entirely. In the illustrated embodiment, by way of example, the gap 78 is $\frac{1}{8}$ inch, the diameter of the pin 20 is $\frac{3}{8}$ inch, and the distance between the inside surfaces 72, 73 of the beams 60, 61 is 1 1/16 inch.

The yoke collar 30 is a sliding cross-piece made from 30% glass-filled nylon or similar material that fixes the relative spacing of the yoke beams 60, 61. The collar 30 is fitted about the yoke beams for snug manual sliding of the collar 30 up and down the beams. The relative position of the collar 30 determines the degree of stiffness of the portion of the beams 60, 61 between the collar 30 and the yoke pins 66 and, therefore, determines the amount of force by the heel pin 20 that will be necessary to force apart the cam latches 26, 27 to release the pin 20.

In operation of the ski 12 in the normal cross-country mode (see FIGS. 2 and 4), the yoke 28 is in a first, downward, position. The yoke flexible beams 60, 61 are out of operative contact with the cam latches 26, 27, and the cam latches are accordingly in their open, first, position (see FIG. 4) in response to the spring 54 biasing them outwardly. The heel pin 20 is not restrained in any way against upward translation, and the skier's shoe 16 is movable in the typical cross-country mode.

To put the ski 12 and heel 14 in the downhill mode (see FIGS. 3 and 5), the heel pin 20 is directed to between the cam latches 26, 27, guided by the guide plate 38. As the heel pin 20 descends, the groove sides 42 forming the V-shaped groove 40 in the guide plate 38 guide the pin 20 to alignment with the cam latches 26, 27. With the heel pin 20 down and aligned by the guide plate 38, the yoke 28 is moved upward, rotating about its axis 70. The inside surfaces 72, 73 of the flexible beams 60, 61 of the yoke 28 operatively and slidingly engage the outside surfaces 58, 59 of the cam latches 26, 27 urging the cam latches inward toward their second position in which the cam latch inside surfaces 52, 53 secure the heel pin 20 (see FIG. 5). At the end of the latching movement, the yoke flexible beams 60, 61 are in their upward, second position (see FIG. 3), and the cam latches 26, 27 are in their closed, second, position (see FIG. 5). The spacing between the flexible beams 60, 61 is chosen so that it is slightly less than the width of the cam latches 26, 27, providing a tension when the yoke 28 is in the second position that keeps the yoke in place.

If a substantial force is placed on the heel pin 20, however, the pin can be released from the cam latches 26, 27. The yoke flexible beams 60, 61 will yield outwardly because of their flexibility if outward force is placed on the cam latches 26, 27. The upper cam surface portions 76, 77 of the cam latch inside surfaces 52, 53 are shaped so that a substantial force, generally upward, on the pin 20 will urge the latches 26, 27 outward and widen the gap 78 between the latches enough so that the pin will escape them.

The amount of force necessary to release the pin 20 can be adjusted by varying the position of the yoke collar 30 along the length of the flexible beams 60, 61. The closer the yoke collar 30 is to the lower end of the yoke 28, the less effective flexibility (the more effective stiffness) there will be in the beams 60, 61, and the more force will be required to force apart the cam latches 26, 27 to release the pin 20. The position of the yoke collar 30 is adjusted by manually sliding the collar 30 up or down the length of the beams 60, 61.

The invention thus provides a quick and easy way to convert a cross-country ski to one that can be used in the downhill fashion by binding the heel of the cross-country skier's shoe to the ski. The yoke 28 is easily manipulated, and its operative position is easily determined at a glance. The shoe heel can be released, at an adjustable force, from the binding in the event of a fall, and that force is easily adjustable by manually positioning the yoke collar 30.

These features are provided by the illustrative embodiment described above, and modifications of the embodiment in many ways will not affect the features. The configuration of the heel pin or the way it is attached to the heel, the materials with which the components are made, the particular configurations of some of the surfaces, may all be varied as well as other aspects of the described embodiment, by those skilled in the art, without departing from the scope of the invention as defined in the following claims:

I claim:

1. A heel binding for a cross-country ski comprising:

a base adapted to be fixed to said ski, oppositely facing first and second latch members, said first and second latch members having oppositely facing first and second latch surfaces, respectively, said first and second latch members being rotatably mounted on said base for movement between a first position in which said first and second latch surfaces are spaced apart and a second position in which said first and second latch surfaces are close and releasably secure a portion of said heel between them, biasing means connected to said latch members to bias said latch members in said first position, and spaced apart first and second flexible beam means mounted on said base for movement between a first position in which said beam means are out of operative contact with said latch members, and a second position in which said first and second flexible beam means flexibly hold said first and second latch members in said latch member second position, said first and second latch surfaces including first and second cam surface portions, respectively, said cam surface portions being shaped to move said latch members outward against the resistance of said flexible beam means and release said heel portion when substantial force is applied to said heel portion.

2. The heel binding of claim 1 including means for adjusting the stiffness of said flexible beam means.

3. The heel binding of claim 2 in which said adjusting means comprises:

a collar means slidably mounted on said first and second beam means and movable along the length of said first and second beam means.

4. The heel binding of claim 1 in which said latch members are mounted for rotatable movement toward and away from each other on axes parallel to the axis of said ski, and said flexible beam means are mounted on axes transverse to said ski axis.

5. The heel binding of claim 4 in which said first and second latch members have first and second outside surfaces, respectively, that are operatively, slidingly engaged by said first and second flexible beam means to move said latch members to their second position when said beam means are moved from said first to said second position.

6. The heel binding of claim 1 further including guide means for guiding said heel portion to between said latch members.

7. The heel binding of claim 6 in which said guide means comprises a surface defining an upward V-shaped groove aligned with said latch members.

* * * * *